US006012267A

United States Patent [19]

Katsumata

[11] Patent Number: 6,012,267

[45] Date of Patent: Jan. 11, 2000

[54] HYGIENIC PACKAGING MACHINE

[75] Inventor: Yoshiki Katsumata, Wheeling, Ill.

[73] Assignee: Tetra Laval Holdings & Finance, SA, Pully, Switzerland

[21] Appl. No.: 09/031,208

[22] Filed: Feb. 26, 1998

[51] Int. Cl.[7] ..... B65B 55/02

[52] U.S. Cl. ..... 53/425

[58] Field of Search ..... 53/425, 426, 428, 53/431; 422/300

[56] References Cited

U.S. PATENT DOCUMENTS

| | | | |
|---|---|---|---|
| 3,390,969 | 7/1968 | Sullivan et al. | 29/195 |
| 4,788,038 | 11/1988 | Matsunaga | 422/22 |
| 4,910,637 | 3/1990 | Hanna | 361/229 |
| 5,307,435 | 4/1994 | Chihara | 385/92 |
| 5,541,096 | 7/1996 | Nomura et al. | 435/176 |

*Primary Examiner*—Joseph J. Hail, III
*Assistant Examiner*—Dermott J. Cooke
*Attorney, Agent, or Firm*—Welsh & Katz, Ltd.

[57] ABSTRACT

A hygienic packaging machine having disinfecting means throughout is disclosed herein. The disinfecting means may be a photosemiconductor catalyst or antimicrobial stainless steel. The disinfecting means is used in areas of potential microorganism growth. These areas include wherever water may accumulate, areas hidden from the cleaning mechanism, comers of the table to of the machine, and other similar areas. The photosemiconductor catalyst is activated by exposure to light and water. The antimicrobial stainless steel is self activating. The disinfecting means may be used on a machine such as a TETRA REX® packaging machine for forming, filling and sealing gable top cartons.

14 Claims, 5 Drawing Sheets

HYGIENIC PACKAGING MACHINE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to disinfection of packaging machines. Specifically, the present invention relates to the application of an intrinsic disinfecting means to various locations on a packaging machine in order to maintain the hygienic nature of the packaging machine.

2. Description of the Related Art

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank, seal the tops of the cartons, and off-load the filled cartons for shipping.

A popular type of carton is an extended shelf life ("esl") carton due to the added value such a carton presents to a retailer. For example, pasteurized milk processed and packaged under typical conditions has a shelf life at four degrees Celsius of seven to fourteen days while the same milk processed and packaged under esl conditions has a shelf life of fourteen to thirty days. Under esl conditions, juice may have a shelf life of forty to one-hundred twenty days, liquid eggs sixty to ninety days, and egg nog forty-five to sixty days. Thus, esl packaging greatly enhances a product since it extends the time period that the particular product may be offered for sale to the consuming public. An esl carton is the final component of an esl system which entails esl processing and esl filling. In order to have esl filling, the high hygiene zone (the filling station and top sealing station) should be kept sterile in order to prevent contamination of the product or carton during filling and sealing on a form, fill and seal package machine.

After a product run, these packaging machines are usually cleaned by exposure to high pressure cleaning solution. The cleaning solution is introduced into the product tank and the filling pipes, and also sprayed about the machine from various nozzle locations strategically placed to effectively clean as much of the machine as possible. However, many surfaces are not directly sprayed by the high pressure cleaning solution. These areas include but are not limited to the back side of the stations chain, the corners of the table top, and the intersection of two components. Also, the spraying of the cleaning solution is followed by sterile or city water which removes any excess cleaning solution from the machine. The standing water may accumulate on certain surfaces of the table top. All of the areas, the areas blocked from the cleaning solution and the standing water surfaces, are places which enable the growth of microorganisms. The growth and survival of microorgansim colonies is facilitated in these areas, and even increased by the occasional spillage of product into these areas. The accumulation of microorganisms may be source of contamination and recontamination of the machine if these microorganism colonies are not eliminated. Such contamination will adversely effect the processing on the machine, and render the final product a non-esl product.

To resolve this contamination, the current practice is to manually clean these areas at predetermined intervals. However, this manual cleaning adds to the costs, and keeps the machine out of production for a longer period of time. What is needed is an ongoing disinfecting process which will work in tandem with the high pressure cleaning process used on the machine.

BRIEF SUMMARY OF THE INVENTION

The present invention provides a solution to the problem of maintaining the hygienic nature of packaging machines without manual cleaning. The present invention is able to accomplish this by providing a disinfecting means which is integrated into the machine parts, and activated by the current systems on a packaging machine.

One aspect of the present invention is the coating of various components and surfaces of standing water with photosemiconductor catalyst. The areas include the guide rails of the conveyor system, the table top corners, the intersection of various pedestals and the table top, flat or depressed areas of the table top. Another aspect of the present invention is to replace some or all of the above-mentioned areas with plastic components integrated with a photosemiconductor catalyst. Yet another aspect of the present invention is to replace some or all of the above-mentioned areas with antimicrobial stainless steel.

The photosemiconductor catalyst disinfecting means are activated by exposure to light and water. The light may be visible or ultraviolet light, and the source may be the UV sterilization component or any light used for illumination purposes. The water for activation is supplied during the cleaning process. The antimicrobial stainless steel does not need light or water for activation.

It is a primary object of the present invention to provide a packaging machine having certain components coated or integrated with a photosemiconductor catalyst.

It is an additional object of the present invention to provide a packaging machine having areas of standing water coated with a photosemiconductor catalyst.

It is an additional object of the present invention to provide a packaging machine having guide rails for a conveyor chain coated with a photosemiconductor catalyst.

It is an additional object of the present invention to provide a packaging machine having certain components composed of an antimicrobial stainless steel material.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a top perspective view of a packaging machine of the present invention;

Figure 2:
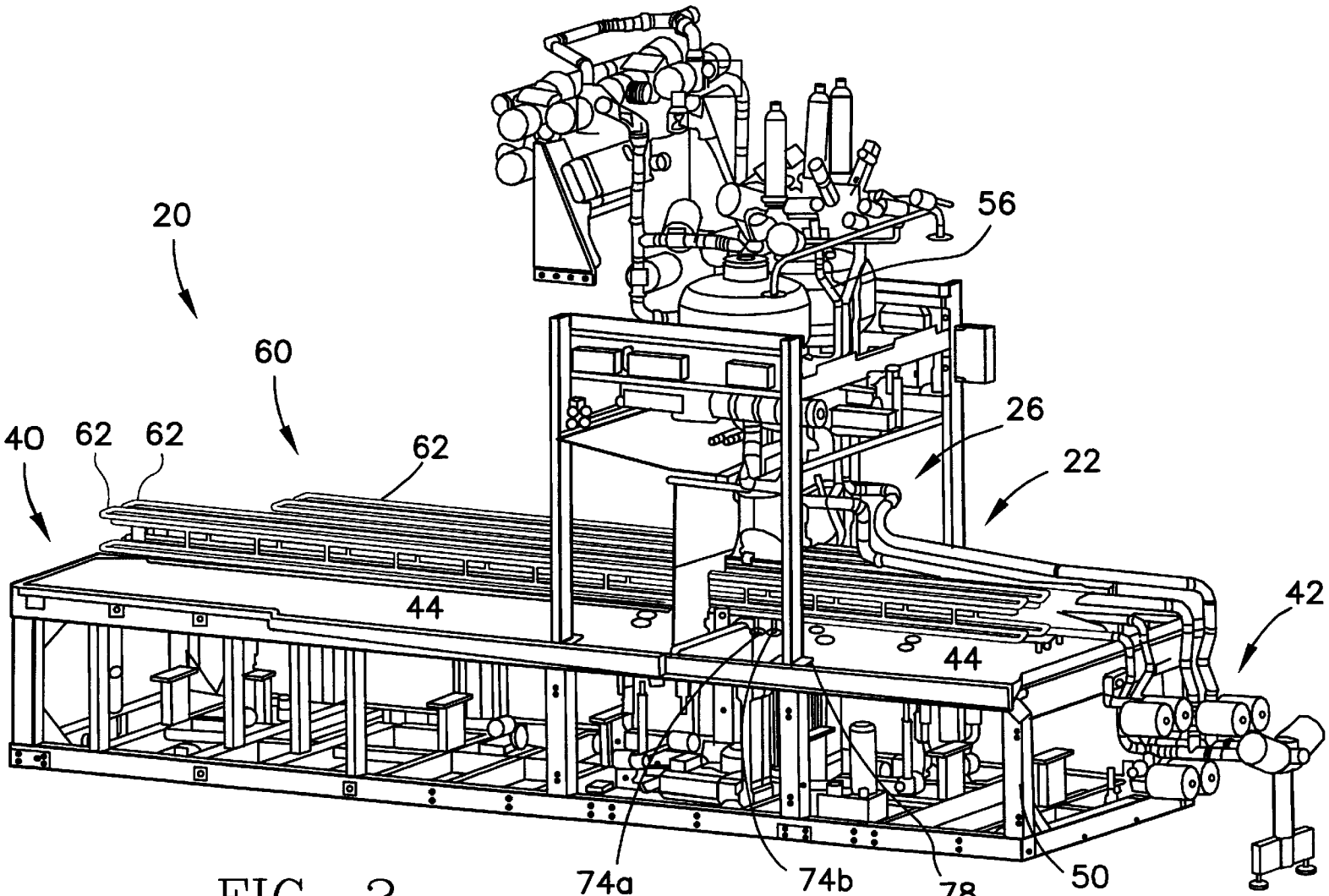
Figure 3:
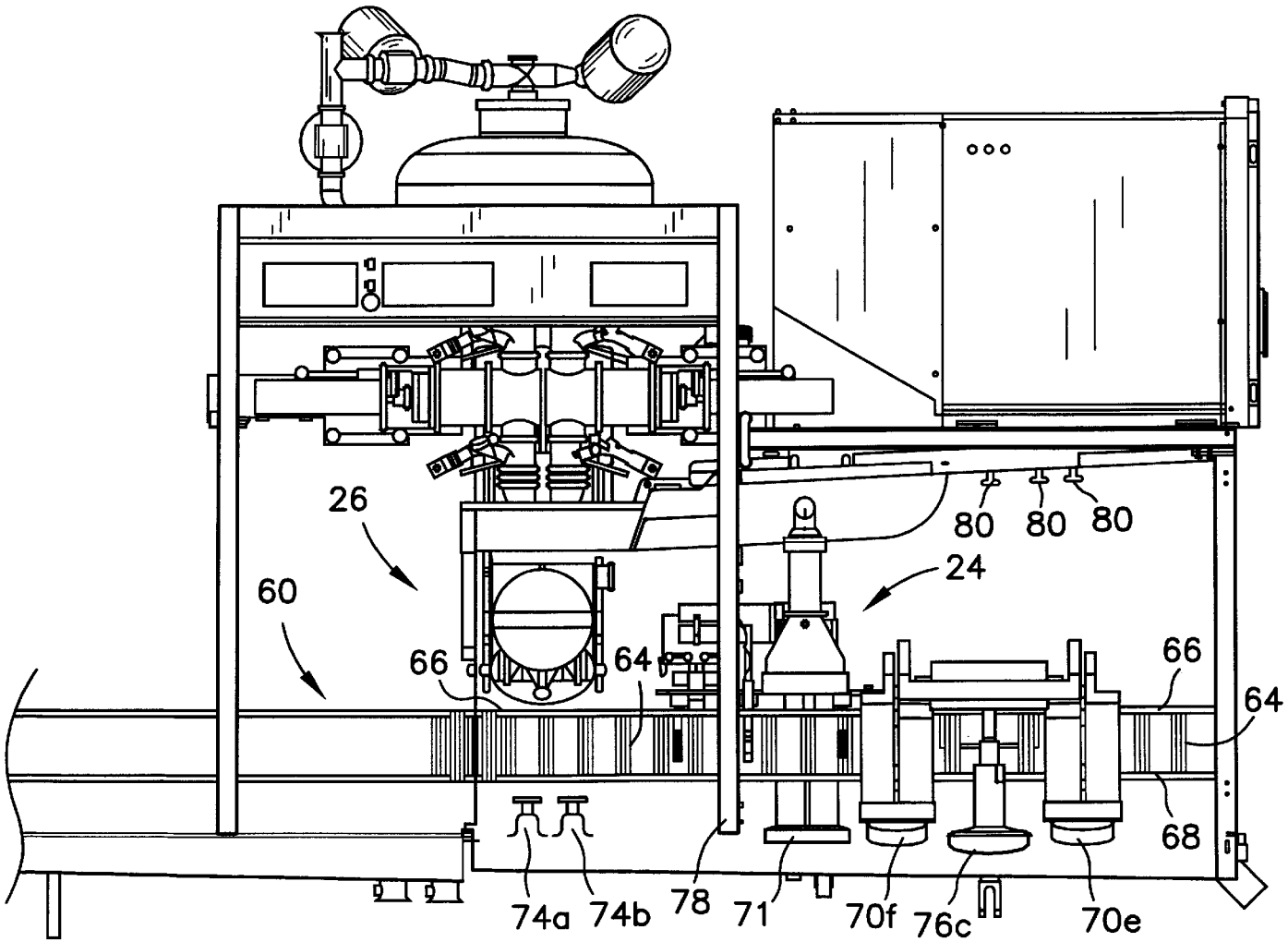
Figure 3A:
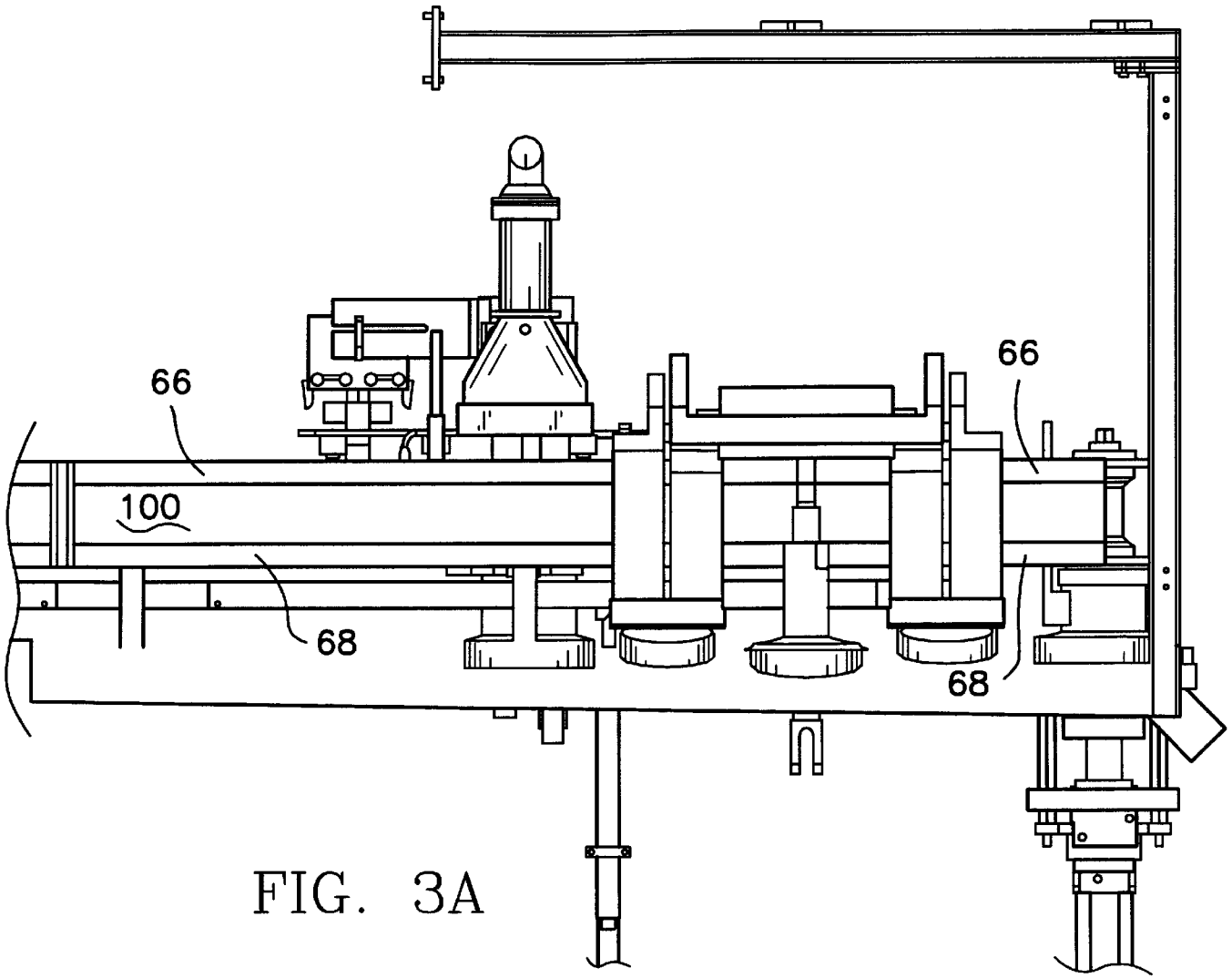
Figure 4:
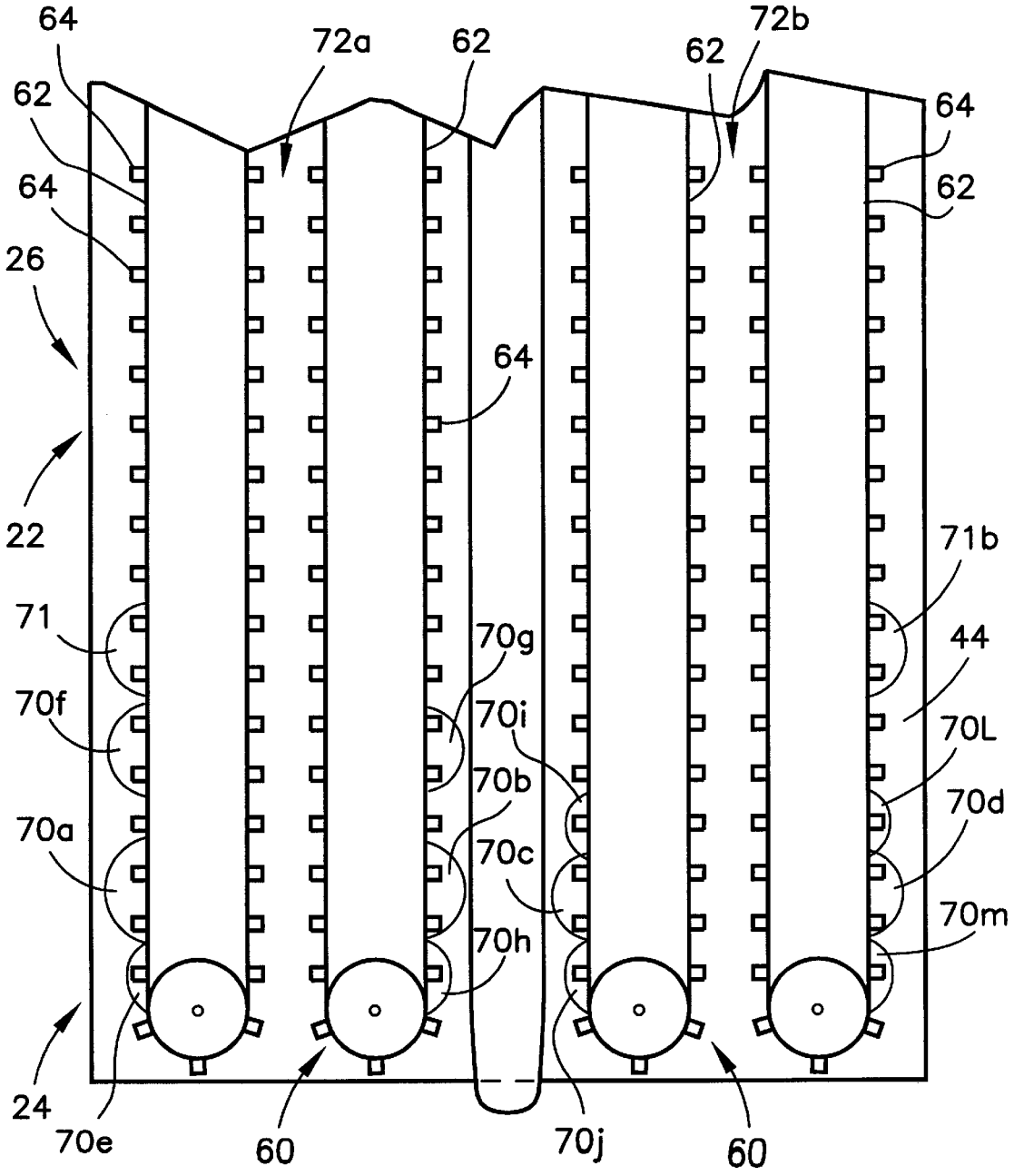

There is illustrated in FIG. 2 a top perspective of a packaging machine of the present invention with the stations removed except for the filling station;

There is illustrated in FIG. 3 a side view of the high hygiene zone of a packaging machine of the present invention;

There is illustrated in FIG. 3A a side view of the high hygiene zone of a packaging machine of the present invention with the conveyor chain removed;

There is illustrated in FIG. 4 a top plan cut-away view of the conveyor system of a packaging machine of the present invention.

DETAILED DESCRIPTION OF THE INVENTION

The present invention is directed in particular to a linear form, fill and seal packaging machine for gable-top cartons such as a TETRA REX® machine available from Tetra Pak, Incorporated of Chicago, Ill. The present invention greatly enhances the hygienic nature of such machines and allows for spaces savings due to the positioning of the fill pipes. However, those skilled in the pertinent art will recognize that the scope and spirit of the present invention may be applied to other packaging machines in necessity of increased hygienic standards.

Photosemiconductors function as semiconductors upon irradiation with light (photons). The photosemiconductors exhibit a conversion of photon to chemical energy action, or photo-activated catalysis, as applied to an electrolysis of water, decomposition of organic matter, and sterilization of germs. since these reactions occur on the surface, it is desirable to increase the surface area to volume ratio. Fine grained particles (5 to 20 microns) produced with various methods are most suitable for this purposes. These photosemiconductor particles are often combined with fine-grained metals such as platinum, silver, or ruthenium oxide so that the photosemiconductor and conductor (metal) in the composite constitute opposite electrodes to promote electrolysis and catalytic activities.

Photosemiconductor particles having photocatalytic function include known photocatalysts such as titanium oxy compounds, zinc oxide, tungsten oxide, iron oxide, strontium titanic, molybdenum sulfide, cadmium sulfide, and the like, which can be used alone or in combination of two or more. Particularly, preferred are titanium oxy compounds having a higher photocatalytic function, higher chemical stability and being harmless. As used in the present invention, the term "titanium oxy compounds" refers to those so-called titanium oxide, hydrated titanium oxide, hydrous titanium oxide, metatitanic acid, orthotitanic acid, titanium hydroxide and the like, the crystal form of which is not critical. The titanium oxy compounds as above may be produced by any one of a variety of known methods. For example, one may make mention of the methods where (1) titanium compounds such as titanyl sulfate, titanium chloride, and organic titanium compounds are hydrolyzed in the presence of seeds for nucleation, if necessary, (2) an alkali is added to titanium compounds such as titanyl sulfate, titanium chloride, and organic titanium compounds in the presence of seeds for nucleation, if necessary, to neutralize, (3) titanium chloride, organic titanium compounds are oxidized in vapor phase, and (4) the titanium oxy compound obtained in the processes (1) or (2) is fired. In particular, the titanium oxy compound produced in the methods (1) and (2) are preferred because of its higher photocatalytic function. As mentioned previously, improvement in photocatalytic function of photosemiconductor particles may be achieved by coating the surfaces of the photosemiconductor particles with metal such as platinum, gold, silver, copper, palladium, rhodium, ruthenium, and/or metal oxide such as ruthenium oxide, nickel oxide and the like.

The sterilization or growth-suppression of germs, fungi and other microorganisms is essential for liquid food packaging machines. A preferred photosemiconductor is rutile (TiO2) which is free of toxicity. Such a substance has been approved as a possible food additive by the Japan Ministry of Health and Welfare. In a preferred composite, it is mixed with a silver metal in fine grained forms for purpose of generating an electrochemical cell function. Hydroxyapatitie is additionally mixed in some applications. A thin film of this photosemiconductor composite may be applied to many base materials such as fabrics and unwoven cloth for application to machine components, or as a coating directly machine components. A source of photosemiconductor catalyst is Shinshu Ceramics Company, Limited of Japan.

Antimicrobial stainless steel has been developed by Nissin Steel Company Limited of Japan. This antimicrobial stainless steel is capable of disinfecting areas where microorganism growth may occur on packaging machines. The antimicrobial stainless steel contains a copper compound. By modifying the stoichiometry of the copper in the antimicrobial stainless steel, it is possible to have obtain disinfecting properties from the antimicrobial stainless steel. Additionally, the stainless steel does not need water or light to activate these disinfecting functions.

Figure 1:
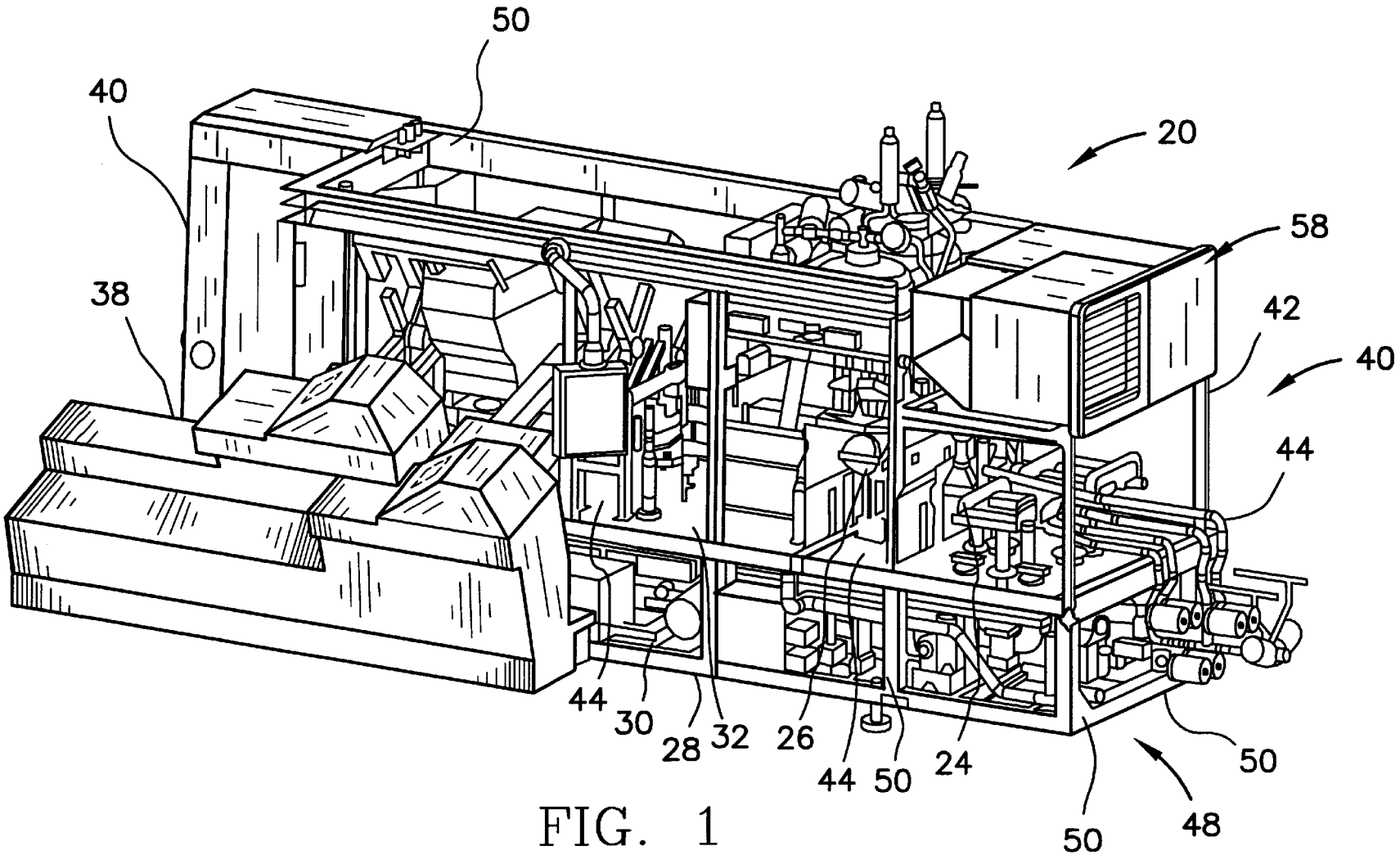

As shown in FIG. 1, a packaging machine 20 for forming, filling and sealing cartons generally includes a high hygiene zone 22 which is composed of a top sealing station 24 and a filling station 26, a sterilization station 28 which is composed of an ultraviolet radiation station 30 and a hydrogen peroxide station 32, a fitment applicator station, a bottom forming station 36 and a carton blank magazine 38. From an operational perspective, the front 40 of the packaging machine 20 is where the processing begins, and the rear 42 is where the finished cartons are dispensed for distribution.

The packaging machine 20 may be divided along a horizontal plane defined by a table top 44. The table top 44 divides the packaging machine 20 into an upper half 46 and a lower half 48. A frame 50 defines the general structure of the packaging machine 20 and supports the table top 44 and the various stations. The lower half 48 of the machine 20 includes serovmotors, drive cylinders, cam drives and other components. The upper half 46 includes the various stations, the product tank 56, the filtered air system 58, the conveyor system 60, not shown in FIG. 1, and other components to process the cartons.

The conveyor system 60 in the high hygiene zone 22 is illustrated in FIGS. 2–5. The conveyor system 60 includes a plurality of continuous conveyor belts 62 having a plurality of carton guides 64 attached thereon for conveying each carton in a predetermined position for processing along the various stations of the packaging machine 20. Each of the belts 62 are engaged with a main drive (not shown). The main drive (not shown) is driven from the lower half 48 of the machine 20 in a shaft and gear arrangement. The cartons are conveyed along the carton paths 72*a–b* to the various stations. The plurality of conveyor belts 62 are each engaged with corresponding upper guide rails 66 and lower guide rails 68. Within the high hygiene zone 22, the guide rails 66 and 68 are coated or otherwise integrated with a photosemiconductor catalyst, or are composed of the antimicrobial stainless steel.

Bridging the conveyor system 60 is the top sealer station 24 which is supported by a plurality of pedestals 70*a–m*,71 attached to the table top 44 on one end, and to the various parts of the top sealing station 24. Also bridging all of the conveyor belts 62 is the filling frame 78 which supports the filling station 26 components. The intersection of the pedestals 70*a–m* and the table top 44, and the intersection of the filling frame 78 and the table top 44, are all areas susceptible to microorganism growth. Within each of the carton paths are a plurality of lifters 74*a–d* (a and b being shown, c and d not being shown). The lifters allows for bottom up filling of the cartons at the filling station 26. The intersection of the lifters 74-*d* (a and b being shown, c and d not being shown) and the table top 44 are areas susceptible to microorganism growth. Also, the intersection of the main drives (not shown) and the table top 44 are areas susceptible to microorganism growth. The areas susceptible to microorganism growth are areas which benefit from the disinfecting means of the present invention. It is these areas where either a photosemiconductor catalyst is applied, or the components are composed of the antimicrobial stainless steel.

In one embodiment, the guide rails 66 and 68 in the high hygiene zone 22 may be composed of brass, and thus the photosemiconductor catalyst 100 is coated thereon through a number of various application means discussed previously. Alternatively, in another embodiment, the guide rails 66 and 68 in the high hygiene zone 22 may be composed of plastic, and the photosemiconductor catalyst is integrated into the plastic material. The guide rails 66 and 68 in the high hygiene zone 22 should be treated with the photosemiconductor catalyst to maintain the hygienic nature of this zone 22. Due to the introduction of product in this zone 22, contamination of the guide rails 66 and 68 is a possibility. This may occur is a container is not placed within one of the guide rails and product is splashed upon the rails 66 and 68, or if sloshing of product within a container occurs which might introduce product onto the rails 66 and 68.

In another embodiment, the guide rails 66 and 68 are composed of the antimicrobial stainless steel. Additionally, the pedestals 70*a–m*, 71 the lifters 74*a–b* and the table top 44 are composed of the antimicrobial stainless steel, and any area in which water may collect and facilitate the growth of microorganisms.

In operation, the photosemiconductor catalyst disinfecting means is activated by exposure to water and light, either visible or ultraviolet. The activation may occur during the normal cleaning process in which a high pressure cleaning solution is followed by sterile or city water. The sterile or city water is provided via the foam sanitizing unit, not shown, and through a number of sprayer nozzles 80 located throughout the packaging machine. The activation of the disinfecting means allows for the destruction of microorganisms which may have grown in the pools of standing water and other areas susceptible to microorganism growth. The antimicrobial stainless steel is continually active and microorganisms contacting the antimicrobial stainless steel are killed.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

I claim:

1. A packaging machine for forming, filling and sealing a series of containers transported along a conveyor system, the packaging machine comprising:

a plurality of standing water surfaces on the packaging machine standing water surfaces having means for disinfecting the plurality of standing water surfaces;

a table top dividing the top of the packaging machine where the series of containers are formed, filled and sealed, from the bottom of the packaging machine, the table top having a plurality of corners; and an ultraviolet light source, wherein at least a portion of the packaging machine is formed from an antimicrobial stainless steel and wherein at least another portion of the packaging machine is coated with a photosemiconductor catalyst that is activated by water and by ultraviolet light emitted from the ultraviolet light source, which when activated, disinfects at least those portions of the packaging machine that are formed from the antimicrobial stainless steel and are coated with the photosemiconductor catalyst.

2. The packaging machine according to claim 1 wherein the conveyor system comprises a plurality of conveyor guide rails for maintaining at least one conveyor chain in a predetermined orientation during conveyance of the series of cartons on the packaging machine, each of the plurality of conveyor guide rails being formed from an antimicrobial stainless steel or being coated with a photosemiconductor catalyst that is activated by water and by ultraviolet light emitted from the ultraviolet light source.

3. The packaging machine according to claim 1 further comprising a plurality of pedestals having means for disinfecting, each of the plurality of pedestals connected on one end to the table top.

4. The packaging machine according to claim 1 wherein the plurality of conveyor guide rails and the plurality of standing water surfaces are all composed of antimicrobial stainless steel.

5. The packaging machine according to claim 6 wherein plurality of pedestals, the plurality of corners of the table top, and the plurality of standing water surfaces are all composed of antimicrobial stainless steel.

6. A packaging machine for forming, filling and sealing a series of containers transported along a conveyor system, the packaging machine comprising:

a table top dividing the top of the packaging machine where the series of containers are formed, filled and sealed, from the bottom of the packaging machine, the table top having a plurality of corners; and a hygiene zone comprising a filling station and a top sealing station, the hygiene zone having a plurality of standing water surfaces coated with a photosemiconductor catalyst; and a source of ultraviolet light for activation of the photosemiconductor catalyst, wherein at least a portion of the packaging machine within the hygiene zone is formed from an antimicrobial stainless steel.

7. The packaging machine according to claim 6 wherein the conveyor system comprises a plurality of conveyor guide rails for maintaining at least one conveyor chain in a predetermined orientation during conveyance of the series of cartons on the packaging machine, each of the plurality of conveyor guide rails coated with a photosemiconductor catalyst.

8. The packaging machine according to claim 6 further comprising a table top dividing the top of the packaging machine where the series of containers are formed, filled and sealed, from the bottom of the packaging machine, the table top having a plurality of comers coated with a photosemiconductor catalyst.

9. The packaging machine according to claim 8 further comprising a plurality of pedestals coated with a photosemiconductor catalyst, each of the plurality of pedestals connected on one end to the table top.

10. The packaging machine according to claim 6 wherein at least a portion of the packaging machine is formed from a plastic material having a photosemiconductor catalyst integrated therein.

11. A packaging machine for forming, filling and sealing a series of containers transported along a conveyor system, the packaging machine comprising:

a table top dividing the top of the packaging machine where the series of containers are formed, filled and sealed, from the bottom of the packaging machine, the table top having a plurality of corners; and a hygiene zone comprising a filling station and a top sealing station, the hygiene zone having a plurality of standing water surfaces composed of antimicrobial stainless steel, wherein at least a portion of the machine within the hygiene zone is coated with a photosemiconductor catalyst that is activated by water and ultraviolet light; and an ultraviolet light source for activating the semiconductor catalyst.

12. The packaging machine according to claim 11 wherein the conveyor system comprises a plurality of conveyor guide rails for maintaining at least one conveyor chain in a predetermined orientation during conveyance of the series of cartons on the packaging machine, each of the plurality of conveyor guide rails composed of an antimicrobial stainless steel.

13. The packaging machine according to claim 11 further comprising a table top dividing the top of the packaging machine where the series of containers are formed, filled and scaled, from the bottom of the packaging machine, the table top having a plurality of corners composed of an antimicrobial stainless steel.

14. The packaging machine according to claim 13 further comprising a plurality of pedestals composed of an antimicrobial stainless steel, each of the plurality of pedestals connected on one end to the table top.

* * * * *